US006283617B1

(12) United States Patent
Stekelenburg

(10) Patent No.: US 6,283,617 B1
(45) Date of Patent: Sep. 4, 2001

(54) BRACKET STRUCTURE FOR HALOGEN LIGHT

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 0 days.

(21) Appl. No.: 09/471,164

(22) Filed: Dec. 23, 1999

(51) Int. Cl.[7] ..... F21V 14/00

(52) U.S. Cl. ..... 362/370; 362/432; 362/371; 362/388; 362/399; 362/400; 362/190; 362/191; 248/126; 248/226.11; 248/200; 248/274.1

(58) Field of Search ..... 362/432, 370, 362/371, 388, 399, 400, 190, 191; 248/126, 226.11, 200, 274.1

(56) References Cited

U.S. PATENT DOCUMENTS 2,616,029 * 10/1952 Osowski ..... 362/190
3,543,016 * 11/1970 Jones ..... 362/432
5,342,140 * 8/1994 Glass ..... 362/191
6,079,852 * 6/2000 Kamaya et al. ..... 362/287

* cited by examiner

*Primary Examiner*—Stephen Husar
*Assistant Examiner*—Anabel M Ton
(74) *Attorney, Agent, or Firm*—Dougherty & Troxell

(57) ABSTRACT

The present invention relates to a bracket for a halogen light, which is made from a strip plate body by folding. The bracket includes a pair of positioning plates, a first pair of folded plates form a larger spacing, a second pair of folded plates folded inwardly from the first pair of folded plates, a third pair of folded plates folded inwardly into several angles from the second pair of folded plates, with a fourth folded plate connected between ends of third pair of folded plates. A plurality of holes and slots are provided on the folded plates to enable mounting the bracket to an article in a variety of positions.

2 Claims, 4 Drawing Sheets

BRACKET STRUCTURE FOR HALOGEN LIGHT

FIELD OF THE INVENTION

The present invention relates to bracket for halogen light, which enables halogen light projection at various angles. The present invention belongs to the field of lamps and lanterns.

BACKGROUND OF THE INVENTION

A conventional bracket for attaching halogen light (as shown in FIG. 7) has a plate body of strip metal with two 90° angles, with its ends mounted by screws at both sides of the halogen light. Such an attaching bracket can provide only a rotating angle of the lamp body, with the fixing points attached to the both sides of lamps and lanterns as an axis. The direction of light projection for halogen light depends upon the bracket structure, and the bracket structure is in turn limited by the shape and position of the articles to which it is attached. Such a bracket structure allowing only mono-directional movement cannot provide an ideal effect.

SUMMARY OF THE INVENTION

The object of the present invention is to provide a bracket for a halogen light that can provide multidirectional light projection when the light is mounted on a wall, scaffold, etc. At the same time the bracket does not hinder the halogen light from rotation.

The bracket is made from a strip plate body by folding, and consisting of a pair of positioning plates parallel to each other, a hole provided on each end, which is in same axis and used for the screw attached to the halogen light. A first pair of folded plates which are folded outwardly from the positioning plates, in order to form a larger spacing. A second pair of folded plates are folded inwardly from the ends of the first pair of folded plates. A third pair of folded plates are folded inwardly at angles to the ends of the second pair of folded plates, on which several holes and slots for fixing are provided. A fourth folded plate is connected to ends of the third pair of folded plates, which is aporoximately parallel to the axis formed by the holes of the positioning plates. Several holes and slots for fixing are provided on the fourth plate.

DETAILED DESCRIPTION OF THE PREFERRED EMBODIMENT

Figure 7:
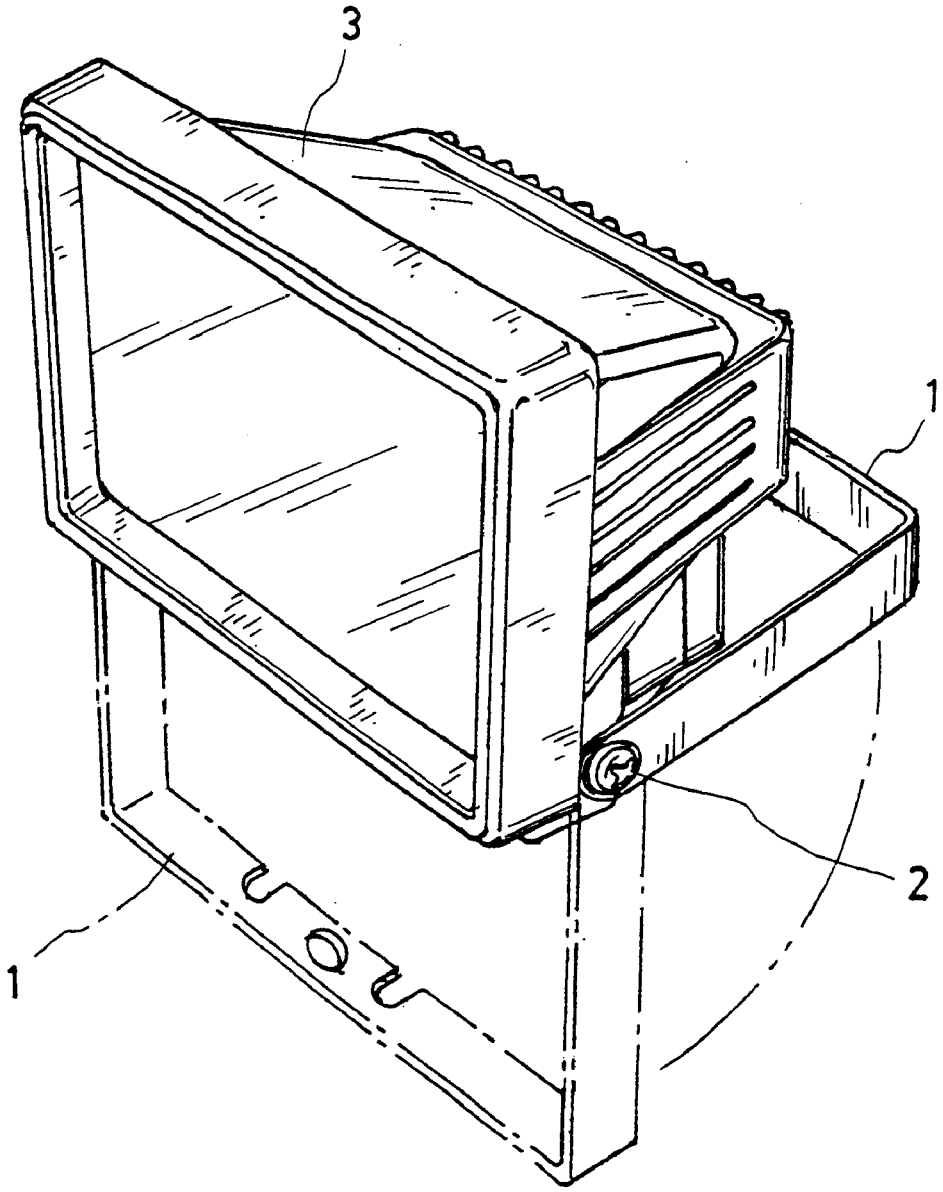
FIG. 7 (PRIOR ART)
FIG. 7 is a perspective view of a conventional light bracket.

A conventional device is shown in FIG. 7. The device has a bracket 1, two screws 2 and a halogen light 3. There are threaded holes (not shown) provided on both sides of such halogen light, and the both threaded holes are provided on a common axis. The halogen light mounted with the bracket can be rotated (or swung) about its axis and then positioned.

Figure 1:
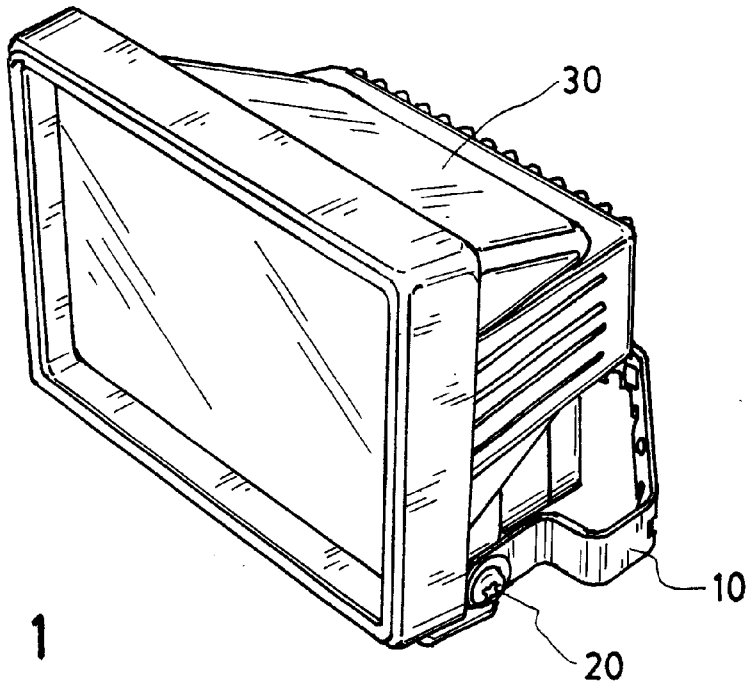
FIG. 1 is a perspective view of a halogen light having the bracket of the present invention.

As shown in FIG. 1, the present invention consists of a bracket 10 which is folded from a plate body of strip metal and mounted on the halogen light 30 by means of screws 20.

Figure 2:
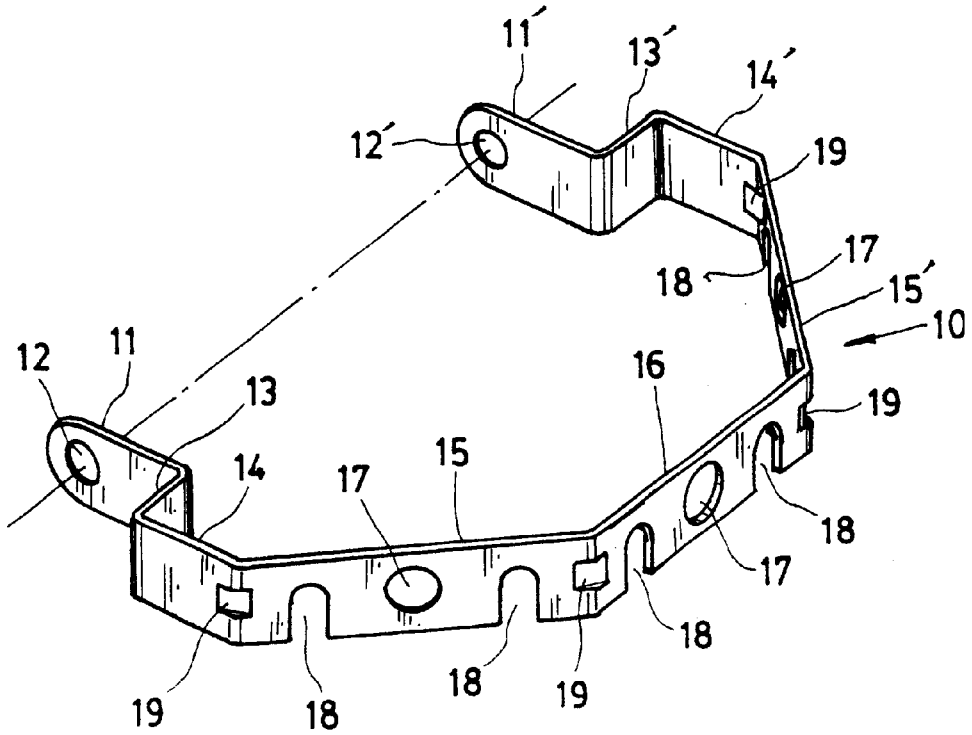
FIG. 2 is a perspective view of the bracket.

As shown in FIG. 2, the strip body has a pair of parallel positioning plates 11, 11', with holes 12, 12' provided on the same axis between the positioning plates 11, 11', so as to enable the present invention to be attached to the halogen light. The first pair of folded plates 13, 13' are folded outwardly from each end of positioning plates 11, 11', giving bracket 10 a wider spacing. The second pair of folded plates 14, 14' are, in turn, folded inward y from the folded plates 13, 13'. Both are formed approximately parallel. The third pair of folded plates 15, 15' are folded from ends of folded plates 14, 14' and the fourth folded plate 16 is connected between the ends of folded plates 15, 15' such that the fourth folded plate 16 is approximately parallel to the axis between both holes 12, 12'. A plurality of holes 17 or slots 18 provided on each of the third pair of folded plates 15, 15' and the fourth folded plate 16, so as to enable screws, hangers, etc., to fix the bracket 10 of the present invention on articles (such as well, scaffold, etc.). Reinforced ribs 19 for positioning folded position are provided between the second pair of folded plates 14, 14' and the third pair of folded plates 15, 15', as well as between the third pair of folded plates 15, 15' and the fourth folded plate 16.

Figure 3:
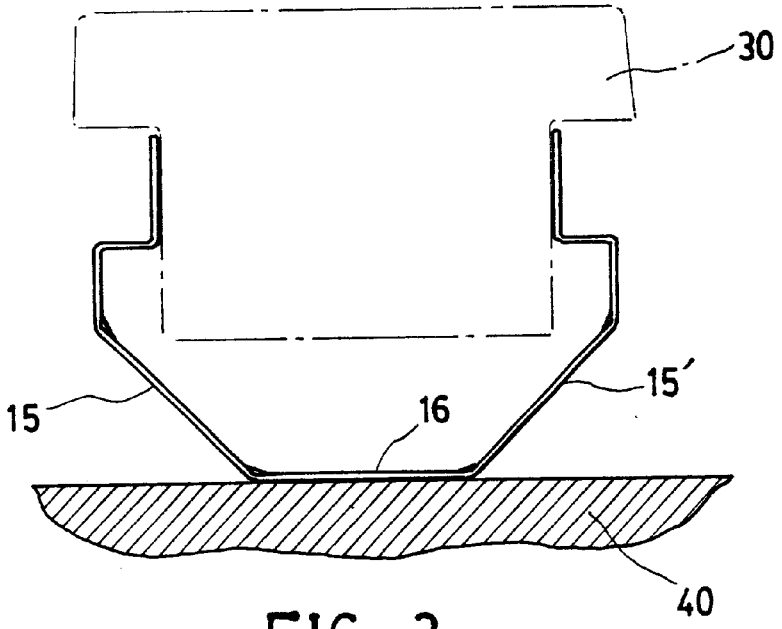
FIG. 3 is a first position of attachment of the bracket.
Figure 4:
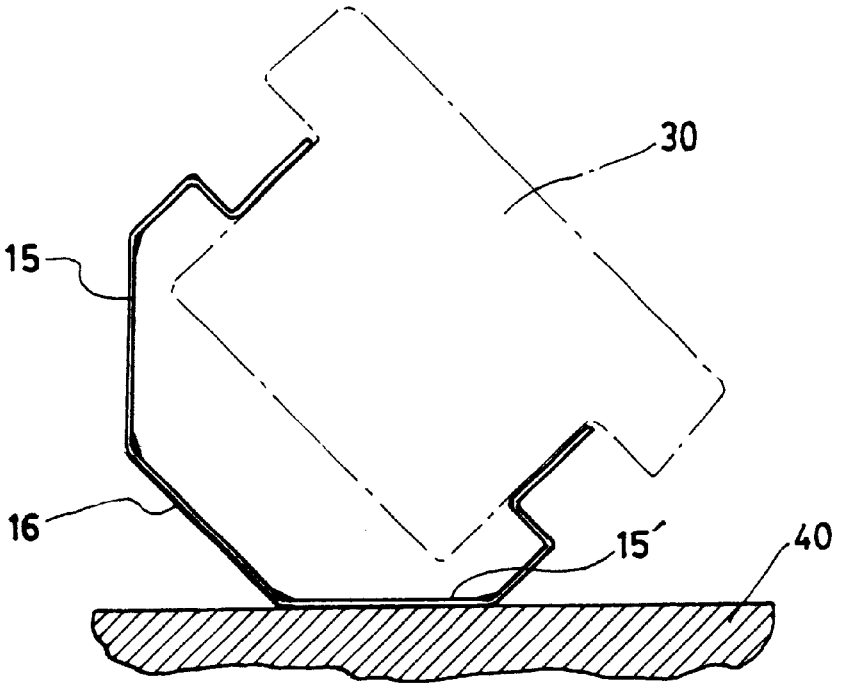
FIG. 4 is a second position of attachment of the bracket.
Figure 5:
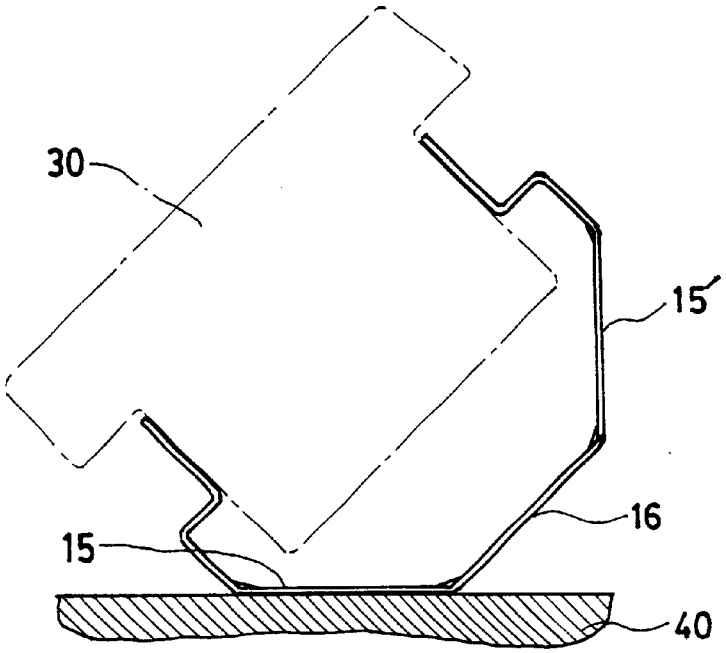
FIG. 5 is a third position of attachment of the bracket.
Figure 6:
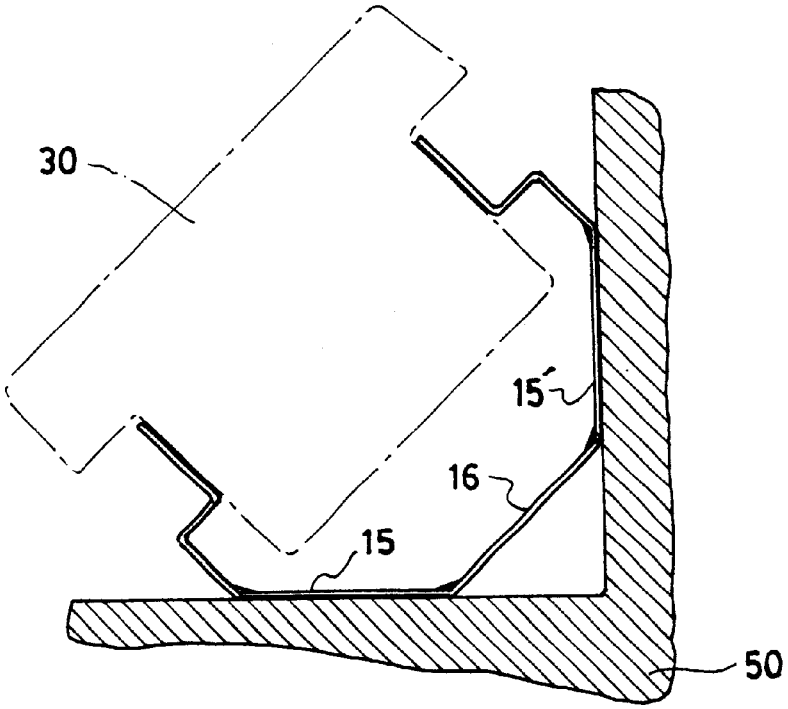
FIG. 6 is a fourth position of attachment of the bracket.

As shown in FIGS. 3 to 6, the bracket 10 is fixed on the articles 40 in various positions. The fourth folded plate 16 is fixed on the article 40 as shown in FIG. 3, so as to provide the halogen light to provide a front projection (corresponding to the function of conventional projection). The folded plate 15' of the third pair of folded plates 15, 15' may be fixed on the article 40 as shown in FIG. 4, so as to provide a projection of approximately 45° in a side direction. The folded plate 15 of the third pair of folded plates 15, 15' may be fixed on the article 40 as shown in FIG. 5, to provide the projection with an opposite 45° angle to a side direction. The third pair of folded plates 15, 15' are both fixed on the attached article 50 with approximately a 90° corner as shown in FIG. 6, so as to adapt to the shape and position of other articles.

The bracket of the present invention as shown in FIGS. 3 to 6 allows the halogen light to project light at different angles. The present invention can also enable multiple projective angles by attachment to articles with other forms.

In summary, the bracket of the present invention can readily provide multidirectional projection from the halogen under the strong and stable conditions.

What is claimed is:

1. A bracket for mounting a halogen light in a plurality of mounting positions, the bracket comprising:

a) a pair of spaced apart positioning plates extending parallel to each other, each having a hole therethrough to enable the bracket to be attached to the light, the holes located on a common axis;

b) a pair of first plates extending outwardly from ends of the pair of positioning plates;

c) a pair of second plates extending from ends of the pair of first plates, the pair of second plates being spaced apart a distance greater than a distance between the pair of positioning plates;

d) a pair of third plates extending from ends of the pair of second plates at an angle of approximately 45°;

e) a fourth plate extending between ends of the pair of third plates, whereby the fourth plate is substantially parallel to the common axis and a length of the fourth plate being less than the distance between the pair of second plates; and, f) at least one mounting hole and at least one mounting slot through each of the pair of third plates and the fourth plate.

2. The bracket of claim 1 further comprising a reinforcing rib located at the junctures of the second and third plates, and at the junctures of the third and fourth plates.

* * * * *